US006837835B2

(12) United States Patent
Huang

(10) Patent No.: US 6,837,835 B2
(45) Date of Patent: Jan. 4, 2005

(54) EXERCISE BALL DEVICE

(76) Inventor: Yang-Chin Huang, No. 2, Alley 492, Hai Tian Rd. Sec. 2, Tainan City (TW)

( * ) Notice: Subject to any disclaimer, the term of this patent is extended or adjusted under 35 U.S.C. 154(b) by 22 days.

(21) Appl. No.: 10/316,585

(22) Filed: Dec. 9, 2002

(65) Prior Publication Data

US 2004/0110611 A1 Jun. 10, 2004

(51) Int. Cl.[7] ..... A63B 21/02
(52) U.S. Cl. ..... 482/126; 482/122
(58) Field of Search ..... 482/82, 125, 121–123, 482/126, 130, 139; 472/135, 134, 129; 473/424, 425, 426; 446/153

(56) References Cited

U.S. PATENT DOCUMENTS 724,473 A * 4/1903 Hendrickson ..... 482/89
4,130,276 A * 12/1978 Tricarico ..... 482/88
5,230,682 A * 7/1993 Myers ..... 482/122
5,282,777 A * 2/1994 Myers ..... 482/122
5,735,776 A * 4/1998 Swezey et al. ..... 482/91
5,810,700 A * 9/1998 Orcutt ..... 482/123
5,833,587 A * 11/1998 Strong et al. ..... 482/123
6,068,580 A * 5/2000 Myers et al. ..... 482/93
6,398,698 B1 * 6/2002 Hinds ..... 482/126
6,524,226 B2 * 2/2003 Kushner ..... 482/126
2003/0195098 A1 * 10/2003 Hsu ..... 482/148
2003/0224914 A1 * 12/2003 De Montesquieux ..... 482/148
2004/0038784 A1 * 2/2004 Huang ..... 482/121

* cited by examiner

*Primary Examiner*—Nicholas D. Lucchesi
*Assistant Examiner*—Victor Hwang

(57) ABSTRACT

An exercise ball device has a ball having two retainer rings, two elastic cables, two end hooks disposed on one end of the elastic cables, two U-shaped handles having holes on the top of the arc sides, two stoppers hanged up on two handles, two hook components having two inelastic belts, and two buckles disposed on one end of the inelastic belts.

2 Claims, 6 Drawing Sheets

EXERCISE BALL DEVICE

BACKGROUND OF THE INVENTION

The present invention relates to an exercise ball device. More particularly, the present invention relates to an exercise ball device, which can be connected with various articles.

A conventional ball is used for a ball game only. A user cannot use the ball to exercise many portions of a human body in a ball game.

SUMMARY OF THE INVENTION

An object of the present invention is to provide an exercise ball device, which can be connected with various articles.

Another object of the present invention is to provide an exercise ball device, which can be used for exercising many portions of a human body.

Accordingly, an exercise ball device comprises a ball having two retainer rings, two elastic cables, two end hooks disposed on one end of the elastic cables, two U-shaped handles having holes on the top of the arc sides, two stoppers hanged up on two handles, two hook components having two inelastic belts, and two buckles disposed on one end of the inelastic belts.

DETAILED DESCRIPTION OF THE INVENTION

Figure 1:
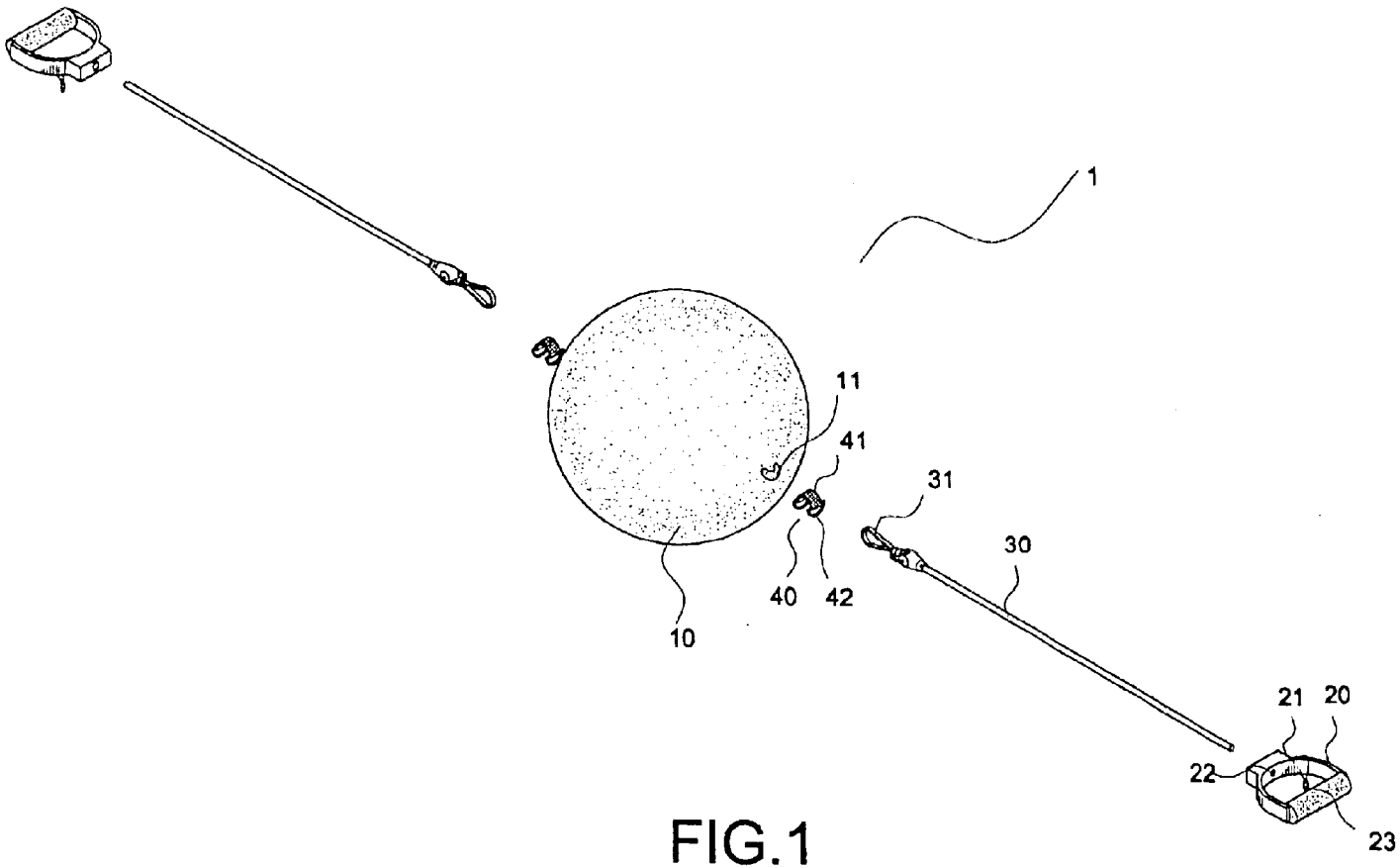
FIG. 1 is a perspective exploded view of an exercise ball device of a first preferred embodiment in accordance with the present invention.
Figure 2:
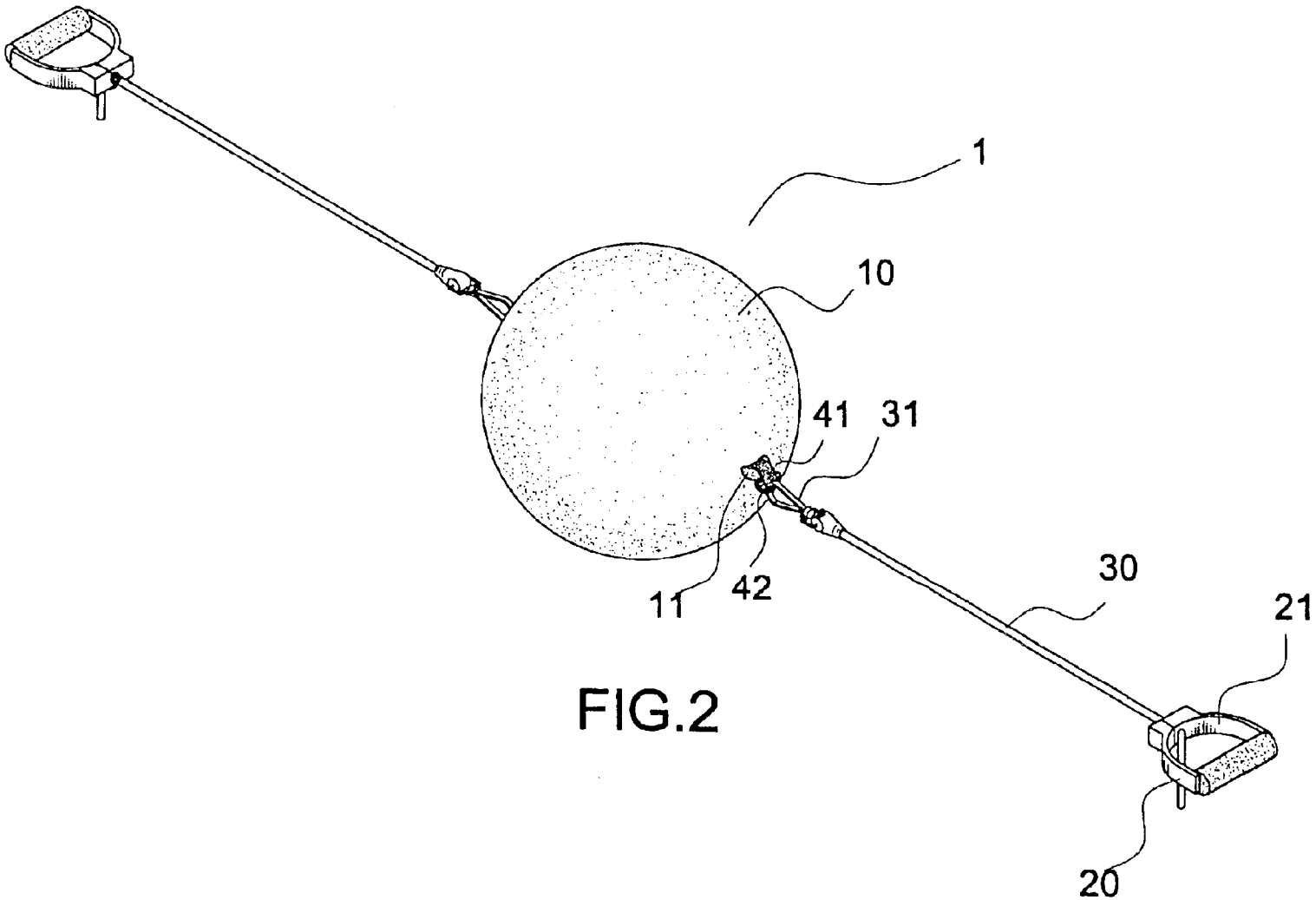
FIG. 2 is a perspective assembly view of an exercise ball device of a first preferred embodiment in accordance with the present invention.

Referring to FIGS. 1 to 4, an exercise ball device 1 comprises a ball 10 having two retainer rings 11, two elastic cables 30, two end hooks 31 disposed on one end of the elastic cables 30, two U-shaped handles 20 having holes 22 on the top of the arc sides 21, two stoppers 23 hanged up on two handles 20, two hook components 40 having two inelastic belts 41, and two buckles 42 disposed on one end of the inelastic belts 41.

Figure 3:
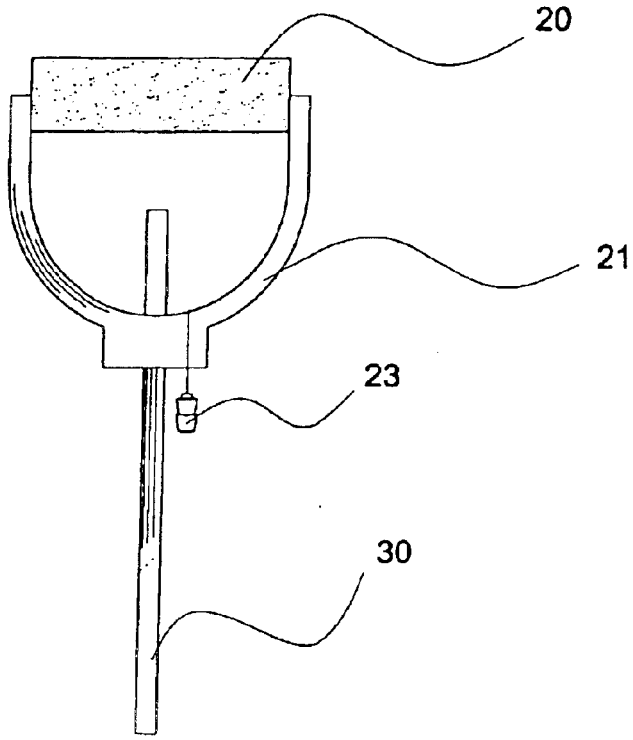
FIG. 3 is a perspective composed view of a handle is connected with an elastic cable.

Referring to FIG. 3, a handle 20 is connected with an elastic cable 30.

Figure 4:
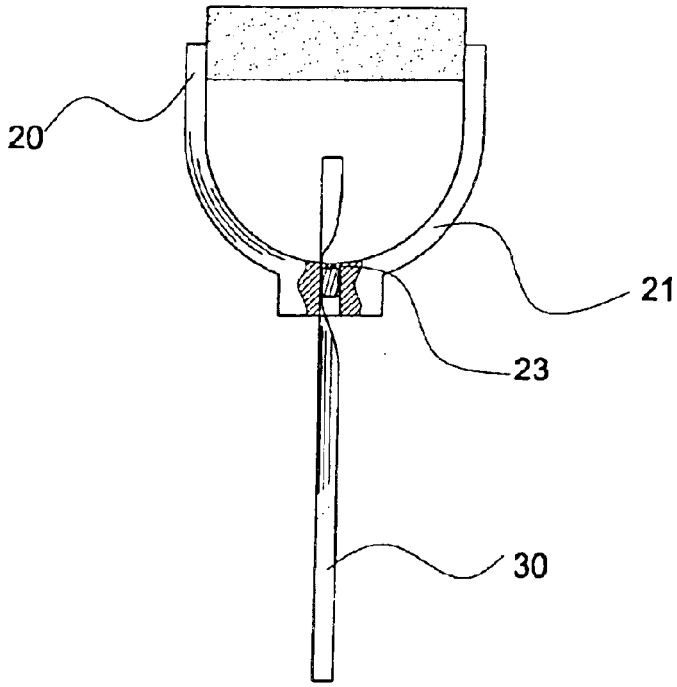
FIG. 4 is a perspective composed view of a handle is connected with an elastic cable and a stopper is in the hole.

Referring to FIG. 4, a handle 20 is connected with an elastic cable 30 and a stopper 23 is in the hole 22.

Figure 5:
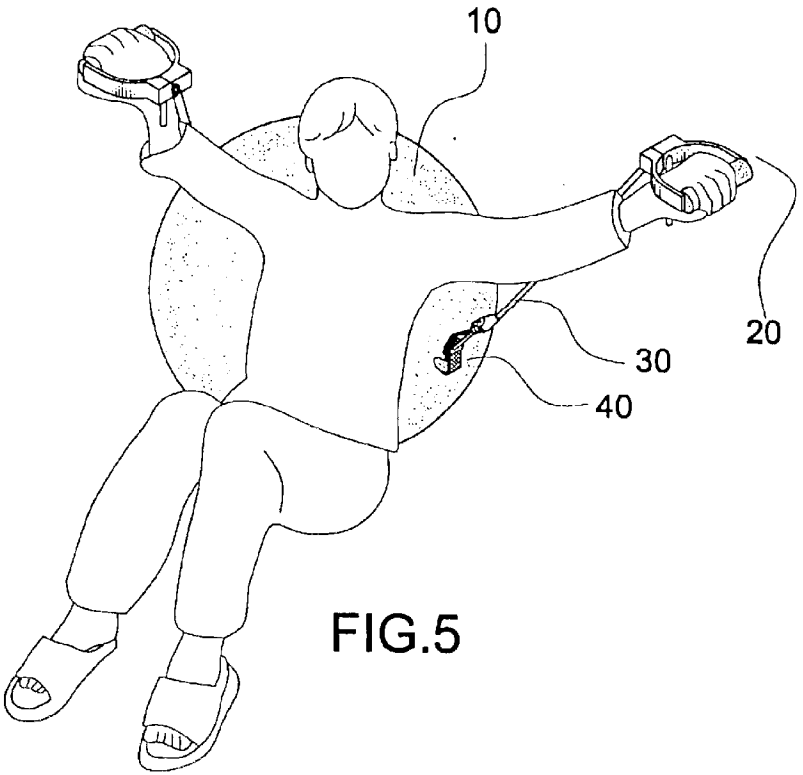
FIG. 5 is a schematic view of a user holds two handles then extends two elastic cables to front side or rear side.

Referring to FIG. 5, a user holds two handles 20 then extends two elastic cables 30 to front side or rear side.

Figure 6:
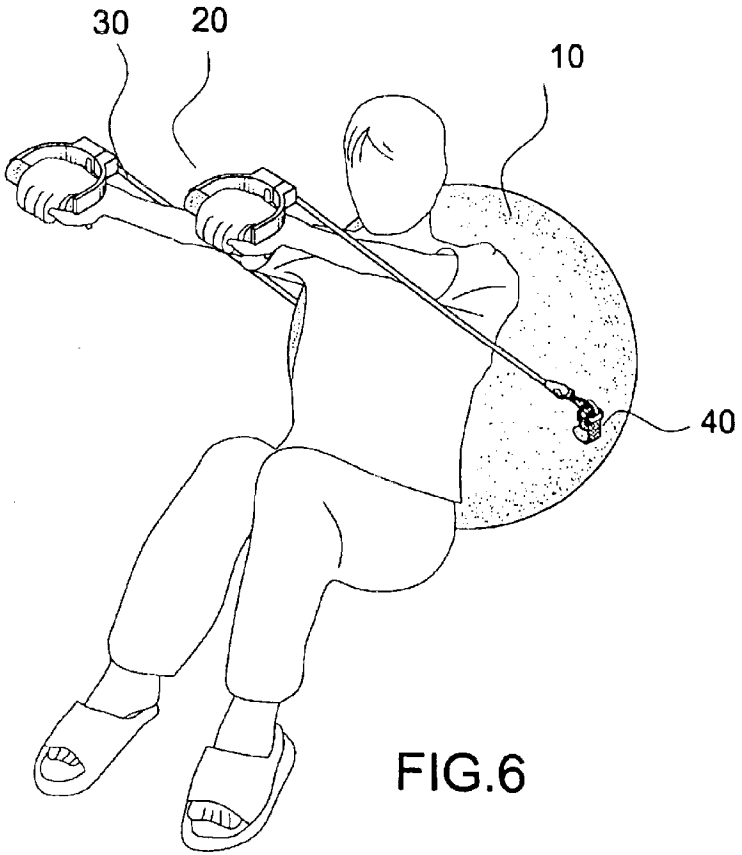
FIG. 6 is a schematic view of a user holds two handles then extends two elastic cables to left side or right side.

Referring to FIG. 6, a user holds two handles 20 then extends two elastic cables 30 to left side of right side.

Figure 7:
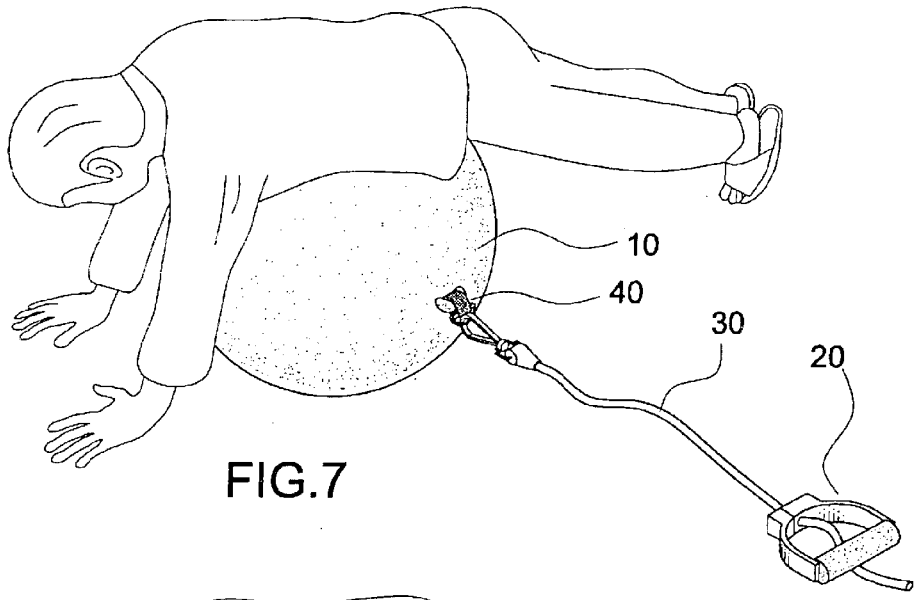
FIG. 7 is a schematic view illustrating a user prostrates himself/herself on a ball.

Referring to FIG. 7, a user prostrates himself/herself on a ball 10.

Figure 8:
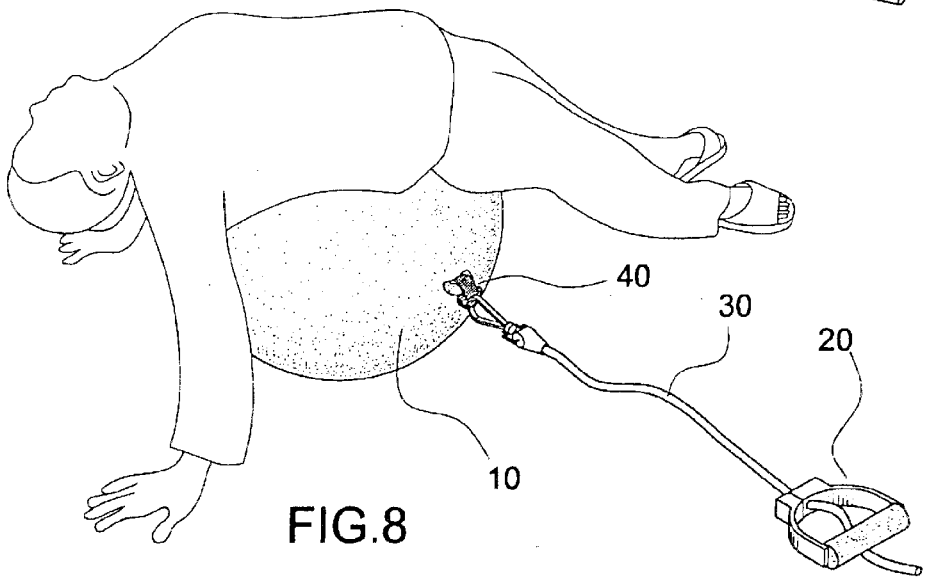
FIG. 8 is a schematic view illustrating a user lies down on a ball.

Referring to FIG. 8, a user lies down on a ball 10.

Figure 9:
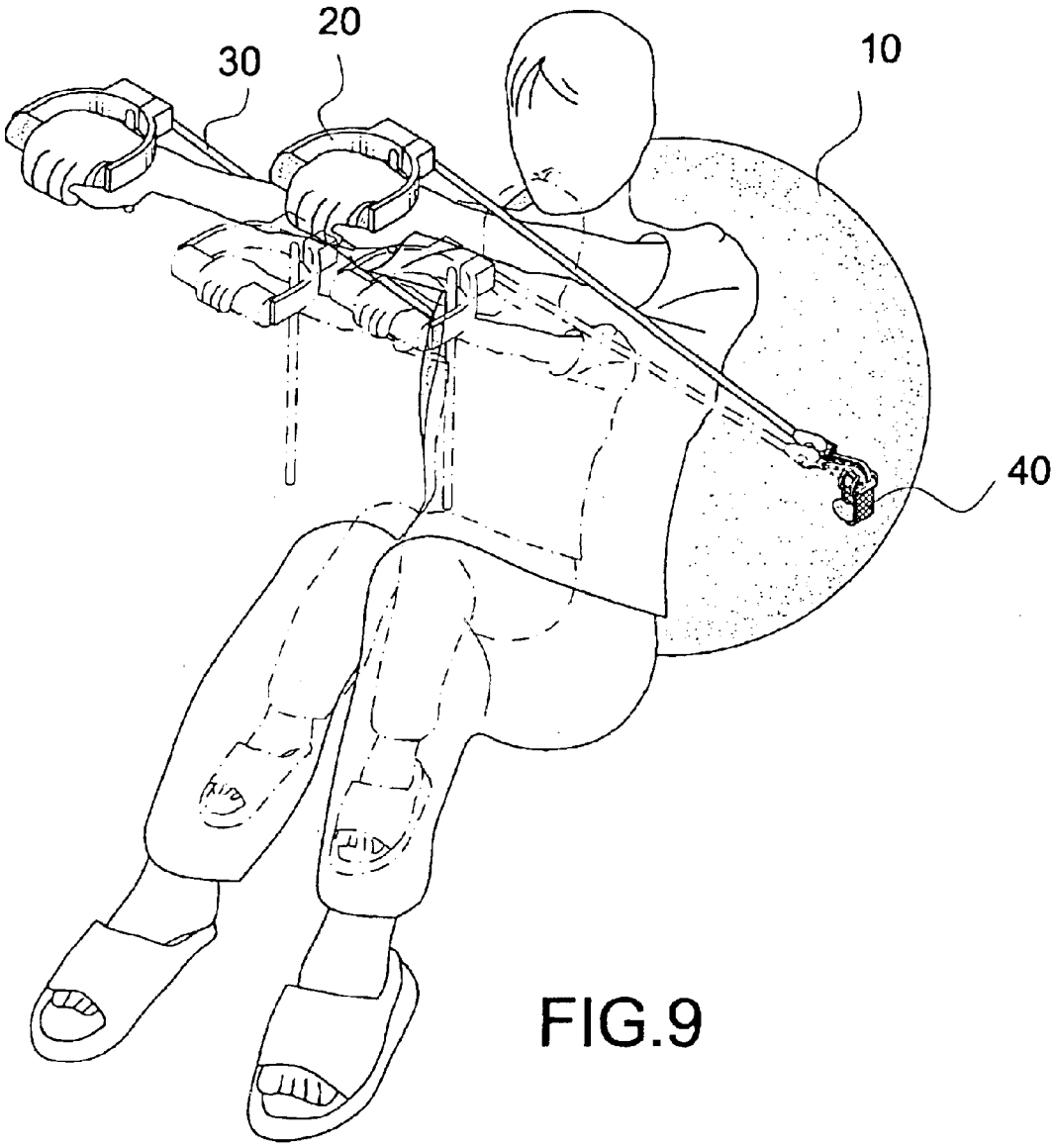
FIG. 9 is a schematic view illustrating a young user holds two handles then extends two elastic cables to front side or rear side.

Referring to FIG. 9, a young user holds two handles 20 then extends two elastic cables 30 to front side or rear side.

The invention is not limited to the above embodiment but various modification thereof may be made. Further, various changes in form and detail may be made without departing from the scope of the invention.

What is claimed is:

1. An exercise ball device comprising:

a ball having two diametric retainer rings mounted to an outer surface of the ball;

two elastic cables;

two end hooks, one end hook disposed on one end of each respective elastic cable;

two U-shaped handles, each having a hole on a top of arcuate sides;

two stoppers, one stopper depending from each respective U-shaped handle; and two hook components, each hook component comprising an inelastic belt with two ends and two buckles disposed one on each end of the inelastic belt, wherein each U-shaped handles is adjustably secured to a respective elastic cable by frictional engagement between a respective stopper and a portion of the elastic cable passing through the hole in the U-shaped handle, and wherein each retainer ring selectively receives a respective inelastic belt and a respective end hook is removably secured to the buckles on the ends of the inelastic belt.

2. The exercise ball device as claimed in claim 1, wherein the ball can be designed in any size.

* * * * *